United States Patent [19]

Tompkins

[11] 4,015,962

[45] Apr. 5, 1977

[54] TEMPERATURE CONTROL SYSTEM UTILIZING NATURALLY OCCURRING ENERGY SOURCES

[75] Inventor: Leo L. Tompkins, Jackson, Miss.

[73] Assignee: Xenco Ltd., Jackson, Miss.

[22] Filed: Dec. 20, 1974

[21] Appl. No.: 534,922

[52] U.S. Cl. ..... 62/2; 62/236; 237/1 A

[51] Int. Cl.[2] ..... F25B 27/00

[58] Field of Search ..... 62/2, 238, 236, 216; 237/1 A; 417/334

[56] References Cited

UNITED STATES PATENTS

| | | | |
|---|---|---|---|
| 2,529,154 | 11/1950 | Hammond et al. | 62/2 X |
| 2,689,090 | 9/1954 | Wetherbee et al. | 62/2 X |
| 2,829,869 | 4/1958 | Philipp | 62/238 X |
| 2,969,637 | 1/1961 | Rowekamp | 62/2 X |
| 3,242,679 | 3/1966 | Puckett et al. | 62/2 |
| 3,752,395 | 8/1973 | Ashikian | 122/26 X |

*Primary Examiner*—William E. Wayner
*Assistant Examiner*—William E. Tapolcai, Jr.
*Attorney, Agent, or Firm*—Sughrue, Rothwell, Mion, Zinn & Macpeak

[57] ABSTRACT

A temperature control system for an enclosed structure is disclosed which utilizes two circuits, one for heating and one for cooling the structure. The system makes maximum use of naturally occurring sources of energy, such as wind and solar heat to provide the requisite heating or cooling. Wind driven compressors, one in each circuit, provide the motive force for the heating and cooling fluid in the closed loop circuits. The cooling circuit transfers heat to the heating circuit to minimize unutilized energy. A storage unit is provided to store heat or low temperature fluid when heating or cooling of the structure is not immediately required.

17 Claims, 3 Drawing Figures

TEMPERATURE CONTROL SYSTEM UTILIZING NATURALLY OCCURRING ENERGY SOURCES

FIELD OF THE INVENTION

The invention relates to temperature control system which supply heat to or remove heat from an enclosed structure via two closed loop circuits containing a fluid at a greater or lesser temperature than the environment to be controlled.

BACKGROUND OF THE INVENTION

In the past, various systems have been presented to utilize naturally occurring sources of energy to heat or cool an enclosed structure, such as a house or office building. More often than not, these systems have been dependent upon solar energy as their sole source of energy input. These systems have not achieved widespread usage due to their inability to achieve consistent heating or cooling due to the unpredictability of the solar energy source.

Systems have also been put forth which introduce means to store heat or "cold" for use at a time when there was no solar energy input. However, these systems also suffer drawbacks, since the storage means becomes prohibitively large if capable of providing for several days of energy without solar input. Also, these systems have typically used a single closed loop cycle with a single fluid in the loop for both heating and cooling. This has resulted in inefficient heating and cooling since the fluid utilized is usually a compromise between a fluid which is capable of maximum efficient heating and a fluid which exhibits similar properties for cooling.

SUMMARY OF THE INVENTION

This invention obviates the difficulties and inefficiencies of the prior systems noted above. The temperature control system of the present invention uses a plurality of sources of naturally occurring energy, namely solar and wind, thus minimizing the probability of there being no energy input into the system. This, in turn, allows the use of relatively smaller energy storage means thus making the system more practical for household use.

The invention uses two closed loop circuits, interconnected only by a heat exchanger, to provide the heating or cooling, one loop providing the requisite heating, the other the cooling. The use of two circuits allows a fluid to be used in each system which is most efficient for its particular function i.e., heating or cooling. This, in turn, increases the overall efficiency of the temperature control system.

The first circuit has a wind driven compressor to pump the heating fluid while increasing its temperature. A solar energy collector also supplies heat energy to the fluid. After passing through a heat exchanger to supply hot water to the household water system, the hot heating fluid either passes into a heat storage means or to a heat radiating device, depending on the immediate needs of the household. After passing through the heat radiating device and giving up its heat, the condensed fluid enters a receiving tank. A conduit connects the receiving tank with a second heat exchanger which interconnects the heating and cooling circuits. Heat from the cooling circuit causes the heating fluid to vaporize and the vapor passes to the compressor.

The cooling circuit utilizes a second wind driven compressor to raise the temperature of the cooling fluid prior to its passing into the second heat exchanger connecting the circuits. After giving up its heat to the heating circuit, a portion of the fluid is flashed into vapor, thereby lowering the temperature of the liquid remaining. Depending on the household needs, the low temperature liquid is either passed into a low temperature storage means or into a heat absorbtion coil to remove heat from the enclosure.

Additional means may be provided to drive the compressors, such as an electric motor or a turbine driven by hot vapor heated by the solar energy collector.

DETAILED DESCRIPTION OF THE PREFERRED EMBODIMENT

Figure 1:
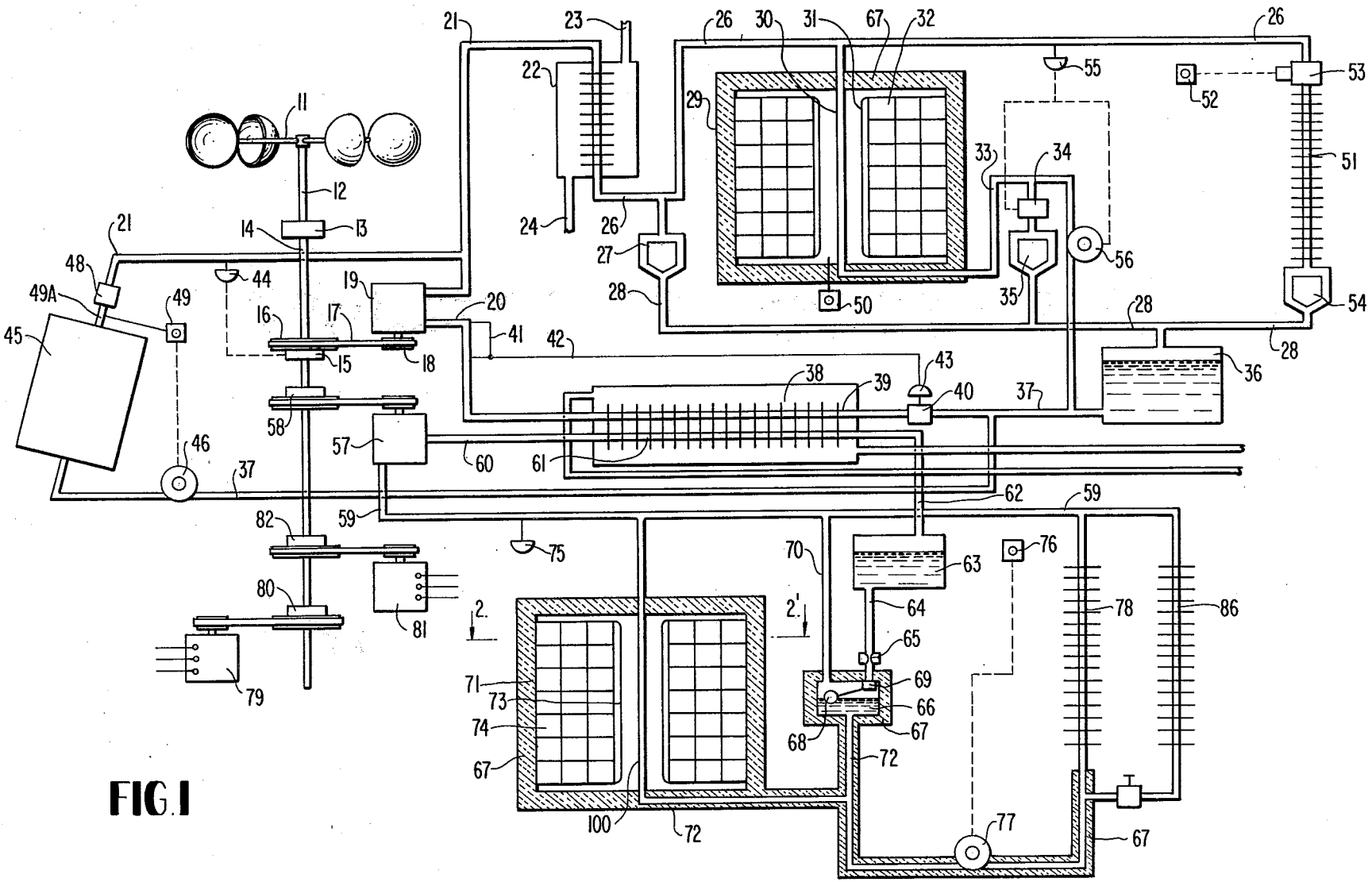
FIG. 1 is a schematic diagram of a temperature control system according to the present invention.
Figure 2:
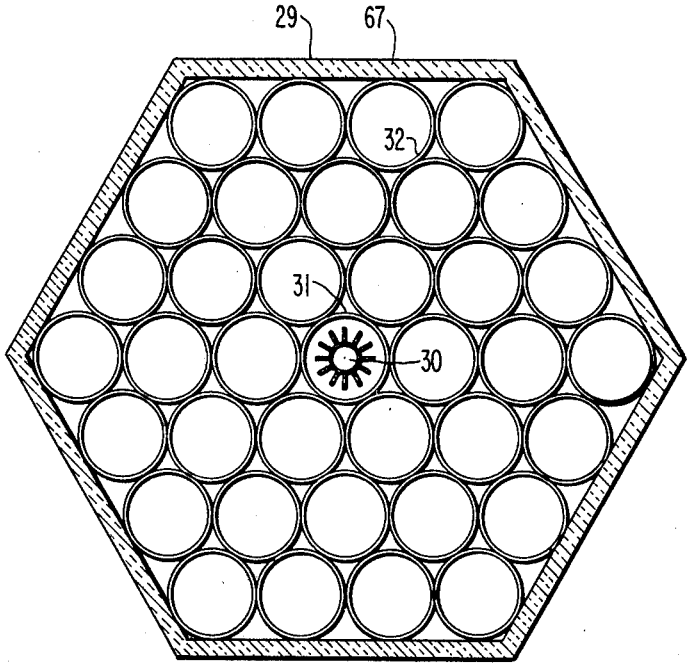
FIG. 2 is a cross-sectional view of the low temperature storage means shown in FIG. 1.

Referring to FIG. 1, a windmill 11 capable of generating several horsepower in an average wind is attached to a vertical shaft 12 to deliver its mechanical energy to an enclosed shelter (not shown) located below the windmill 11. Although not shown in FIG. 1, the windmill may have means to automatically control its speed of rotation and means to automatically prevent its rotation when it is not needed. Any means may be used to retain the windmill 11 in operative position, such as attachment to the enclosed shelter or a separate supporting tower.

Shaft 12 is connected to driven shaft 14 by overrunning clutch 13. Shaft 14 may be oriented in any position and need not necessarily be vertical as shown in the schematic view in FIG. 1. If the shaft 14 is not coaxial with shaft 12, some means must be provided to transfer the rotative movement of shaft 12 to shaft 14. This may be accomplished by such means as a universal joint (not shown) or a gearbox (not shown), although a gearbox is preferable since it would allow shaft 14 to run at a higher or lower speed than shaft 12.

In order to utilize the mechanical power of rotating shaft 14, sheave 16 is coupled thereto via clutch 15. The engagement of clutch 15 causes sheave 16 to rotate and to drive compressor 19 by way of belt 17, and sheave 18, connected to the compressor.

The heating cycle of the present invention will now be described with reference to FIG. 1. Compressor 19 takes vaporized fluid, such as a refrigerant, from conduit 20, compresses it and delivers it at a higher pressure into conduit 21. Since the compressed vapor will be at a much higher temperature than the ambient atmosphere, conduit 21 should be insulated to prevent undesired heat transfer. The compressed vapor, containing the latent heat of evaporation and a quantity of super heat due to the mechanical work done in the compressor passes through a heat transfer means 22. Since the super heat is at a higher potential than the latent heat of evaporation, but does not contain the quantity of heat of the latter, it is best used to heat water for general household use, where the demand is usually less than the heating demand. The water passes into the heat transfer means 22 via inlet 24, is heated by the compressed refrigerant vapor, and passes into the household water system via outlet 23.

Due to the heat transfer to the water, a portion of the heating fluid vapor will condense in conduit 26. The condensate passes through liquid trap 27, into conduit 28 and into receiving tank 36.

The uncondensed vapor in conduit 26 will either pass into heat storage means 29 or will be delivered to radiating coil 51 depending on current household needs. If the household is sufficiently warm and no further heating is required, the vapor transfers its heat to the heat storage means 29 for use at a later time when heating is required. The vapor passes through the heat storage means 29, by way of heat exchanger coil 30 and transfers its heat to a liquid, preferably water, within the heat storage means 29.

A baffle tube 31 surrounds the heat exchanger coil 30 to aid in the circulation of the water which rises due to the heat added by the vapor and then passes out of the top of the baffle tube 31. After passing out of the baffle tube 31, the water gives up its heat to melt a meterial located in each of the cans 32. This material may be any material which will melt in the temperature range for efficient heating of a house, such as paraffin or asphalt. Paraffin is preferred since it comes in various melting temperatures and has a very high specific heat along with a favorable heat of fusion. If higher temperatures are required, asphalt may be utilized in the cans. It is quite inexpensive, is in abundant supply and has a high heat of fusion.

These hydrocarbons could be used without the small cans 32 and melted by direct contact with heat exchanger coil 30, but the illustrated construction utilizing water as the heat transfer medium provides an added safety precaution against a fire, should one break out in the house where it is being used. The water would hold the temperature inside the heat storage means well below the flashpoint of the fusion material.

During the storage process, liquid heating fluid accumulates in the heat exchange coil 30 and is drained off into liquid trap 35 by conduit 33 and automatic valve 34, all of which may be of conventional design. The liquid then flows through liquid collection conduit 28 into the liquid receiver 36. It then passes from conduit 37 through a first heat exchanger 38, where it picks up heat from sources to be described later. The liquid is metered into the lower pressure of the heat exchanger coil 39 through an expansion valve 40, and the super heat in the vapor that comes out of said coil into conduit 20 is monitored by thermostat pick up bulb 41. Said bulb communicates the temperature to said expansion valve through the small line 42, and this temperature information is effective on the valve 40 through bellows 43 to control the super heat at the input to the compressor 19, since the super heat at the compressor high side is proportional to both the input super heat and the increase in pressure through the pump. This control allows operation at a higher saturated vapor pressure in the output line 21 without going over the safe temperature for the lubricating oil used in the system to protect the compressor movements.

Whenever the pressure in conduit 21 goes above a safe value for the compressor 19, a pressure sensor 44 will cause the clutch 15 to disengage and stop the compressor. Operation will be restored when the pressure in line 21 is again at a safe value.

As an additional source of heat energy, solar collector 45 is provided.

Heat from a solar energy collector 45, of any type that can produce a heat level suitable for this system, can be inserted into this system by taking liquid refrigerant heating fluid from receiver 36 through conduit 37 via pump 46. If the said collector is below the level of the said receiver, a valve can be used and the liquid would flow due to gravity. In either case, the liquid is caused to flow into the solar collector 45 and the heat therefrom will be absorbed as the liquid is changed into vapor. This portion of the heating fluid lines does not have forward flow restrictions built into it and the pressure and temperature of the vapor from this collector will be near the same as that from the compressor 19. The two can mix in conduit 21 and add their contributions to the system, individually or together, without the use of valves. A check valve 48 is placed in the output from the collector, however, to prevent back flow of vapor into this unit when it is not receiving solar heat.

A temperature sensing device 49 is placed in the top of the solar collector's outlet pipe 49A to turn on the pump 46 when the temperature is high, and to turn it off when the evaporation of vapor, or the lack of sunshine, cools off the pipe. Heat may be gathered from other sources of sensible heat, of suitable potential, by this same process, and can be inserted into the system just as easily.

Another heat sensing means 50 is installed in the bottom of the heat storage means 29 to detect when this storage has reached capacity, and it signals, through any system of automation (not shown) to shut off all sources of heat, such as by shading the solar collector, turning it away from the sun, or preventing pump 46 from operating, and preventing clutch 15 from operating compressor 19.

Heat is delivered for various uses in much the same way that it is put into storage that is by removing the heat from the heating fluid vapor. Heat radiating, or conducting coil 51 is typical of a heat delivery means in this system. When the thermostat 52 senses a need for heat, it operates through standard control means (not shown) to open valve 53. Heating fluid vapor flows from conduit 26, into the coil 51 where, instead of being insulated like the conduits, the coil is provided with any of several devices commonly used to increase the radiation flow of heat to the surroundings, including the use of a fan (not shown) when needed.

The removal of heat is accompanied by condensation of the vapor and the liquid trap-off valve 54 allows the condensate to flow through conduit 28 to the liquid receiver 36, where it is available for re-use.

When the rate of use of heat is greater than the rate that the sources are supplying heat laden vapor, the pressure in conduit 26 will drop due to the excessive removal of vapor. Pressure sensing means 55 will relay this pressure drop by automatic means (not shown) which will close valve 34 and turn on motor driven pump 56. Liquid will be pumped into the coil 30 inside the heat storage means 29, and the potential of heat retained by the material in the cans 32 will be enough to restore the pressure in conduit 26 by evaporating the liquid supplied by pump 56. It should be mentioned that the temperature of the storage will not change markedly with the quantity of heat in storage as long as some of the material is present in each of the two states, liquid and solid.

This storage means may be said to "float on" the conduit and serves to stabilize the pressure with changes of supply and demand. Because there are only two simple tubes to connect from the storage means to the system, units may be mass produced in a size suitable for moving into existing houses, and the design capacity may be had by ganging several units.

As many heat radiating coils as are needed may be installed and connected to tubing which is easier to install than air ducts, steam pipes, or hot water pipes. In houses where ducted central heating has already been installed, the heat radiating coil may be put into the duct system at the furnace and the same blower can distribute it in the usual way. The furnace need not be rendered inoperative and may be on standby.

In order to cool the household enclosure, a separate low temperature pumping system is utilized. The low temperature pumping system may use a different refrigerant than that of the previously discussed heating system. The cooling system includes a second compressor 57 driven by shaft 14 in a manner similar to the first compressor 19. Clutch 58 controls the operation of compressor 57. To operate the system, the clutch 58 is closed causing compressor 57 to start pumping. It draws refrigerant vapor from conduit 59, compresses it, and puts it into conduit 60, at a higher pressure, and at a higher temperature. This vapor passes into double heat exchanger 38 and into coil 61 where the heat of compression is removed by one of several ways to be described later. The vapor condenses and the liquid flows through conduit 62 to the low temperature receiver 63. From there the liquid flows through conduit 64 having a restriction 65 therein. Restriction 65 not only limits the flow from the low temperature receiving tank 63, but effects a pressure drop to cause some of the liquid to flash into vapor, thereby carrying away some of the heat from the rest of the liquid.

The vapor and liquid pass into float chamber 66, which has an insulation layer 67 therearound, allowing the liquid to remain cold. The liquid will accumulate until the float 68 rises up and closes valve 69. The vapor that separates out to keep the chamber 66 cold, passes through bypass conduit 70 to vapor conduit 59, and back to the compressor 57. The liquid flows into the low-temperature storage means 71, through cold liquid conduit 72. The liquid will have the temperature of the saturated vapor at the pressure of the vapor conduit 59 due to this boil-off principle.

The low temperature storage means 71 operates on the same principle as heat storage means 29 and is constructed similarly thereto. A plurality of cans 74 contain material which is frozen or solidified at a temperature suitable for efficient cooling of living space. Surrounding the cans is a heat transfer medium, such as water. The water gives up heat to the liquid passing upwardly through the heat exchange coil 100. This exchange of temperature causes the liquid to vaporize in the exchange coil 100 and the water to pass downwardly through central baffle tube 73. After thus passing downwardly, the water passes under and around cans 74 to absorb heat given up by the fusion of the material contained therein. After rising to the top and passing between the cans 74, the water cycle begins over again. As long as there is some material unfrozen in the cans, the temperature inside the insulation layer 67 will not change to any large degree. After it is all frozen, the temperature will drop sharply. Switch 75 senses when the temperature is too low, and opens the clutch 58 to compressor 57, to stop the pumping of cold into storage.

When thermostat 76 is set to a colder temperature than ambient, the interconnecting automation (not shown) will cause motor driven pump 77 to move cold liquid into the heat delivery coil 78, the liquid will boil due to the temperature around the coil being higher than the temperature of the saturated vapor of the liquid. Heat is removed by the coil from the surrounding atmosphere and sent to the compressor 57 with the vapor in conduit 59. As there are no restrictions in this cooling cycle, except for the pump 77, that component could be replaced with a valve, if the coil 78 where at a lower level than the liquid in the float chamber 66. This is typical of the cold withdrawal process and any number of coils could be connected to the system. In places where a central air conditioning duct system has already been installed, the present evaporator could be utilized as the cooling coil by removing its expansion valve, or capillary tubes, as the case may be. The present motor, compressor, and condensing coils will not be needed, even as stand-by, because only an electric motor 79 need be added to this system for standby, or auxiliary, service. When it is turned on this motor will turn the line shaft 15 through overruning clutch 80.

The low temperature storage means 71 may also be thought of as "floating on the line" as it differs from the heat storage means only by the material inside the cans. It also has only two simple tubes to connect to the system; it can be produced in the same standard sizes as the heat storage means and ganged on the line to arrange the designed storage capacity.

An electric generator 81 can be driven by shaft 14 through clutch 82 whenever electricity would be useful to the household system, such as supplying electric heat to the house, or storage, when the wind is blowing and the temperatures for heat exchanging are all too low for efficient heat pumping. A better use of the horsepower of the windmill would result from this means.

In mild weather, when the temperature can shift in a few hours, from requiring heat, to a need for cooling good operating policy would require that both storages be kept as near full as conditions permit. Under these conditions, it would be proper to run both compressors at any time that the wind is strong enough, and the most efficient way to do this is to take the heat removed from the low temperature storage means and use it to supply heat for the heat storage. This is one reason for the double heat exchanger.

In cold weather, the cold storage would be emptied each time the environmental temperature goes above the freezing temperature of the material in the low temperature storage means and then this material can be refrozen when the temperature is very low and environmental heat is much harder to pump, and thus is less efficient. This is the other reason for the double heat exchanger, and is a strong argument for the use of water in this storage means. When the low temperature storage means is full and no source of warm environmental heat is available, the windmill could drive an electric generator and use the electricity to generate heat in the heat storage or otherwise. In emptying the low temperature storage means, a heat delivery coil 86 would absorb heat from the surrounding environment and put it into the storage to melt the material.

Figure 3:
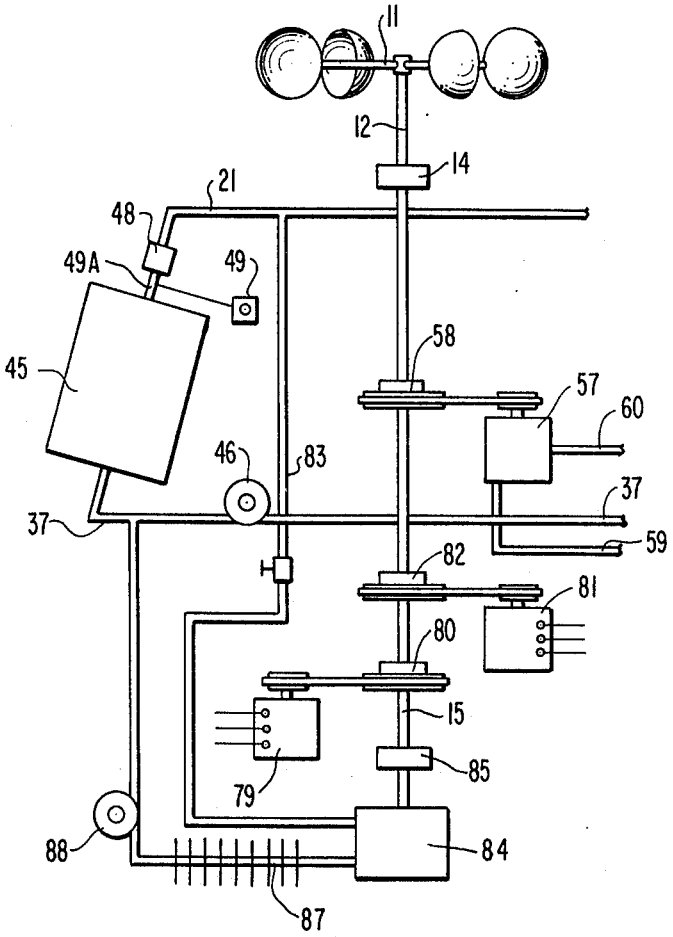
FIG. 3 is a partial schematic diagram showing an alternative embodiment of the temperature control system of FIG. 1.

In extended hot weather, the heat storage would not be important, so would be neglected by the windmill in favor of the cold storage. This could be done as easily as throwing a switch, and in warm climates, the heat storage may be left out altogether, along with the associated compressor and the heating coils, etc. As shown in FIG. 3, liquid working fluid is pumped from an environmental heat exchanger 87 by pump 88, which may have any source of drive power, and the liquid is put under the normal pressure for absorbing heat from the solar heat collector 45 where the heat can then be utilized by generating a pressurized vapor in conduit 83, and this pressure would cause refrigerant vapor to flow through turbine 84 which is coupled to shaft 15 through overrunning clutch 85 and will serve to drive compressor 57 and produce more cold for the house. This process is more economical than the ammonia-water-nitrogen cycle commonly used in gas refrigerations, and which has been suggested as a means to convert solar heat to cold. Then, also, the potential of heat gathered by the collector need not be as high as with the said refrigeration cycles.

What is claimed is:

1. A temperature control system for controlling the temperature within an enclosed structure comprising:
   a. a source of heat;
   b. a first heat exchanger for transferring heat from said source of heat to a liquid passing therethrough so as to cause said liquid to evaporate;
   c. a first compressor connected to said first heat exchanger to raise the temperature and pressure of the evaporated liquid;
   d. a wind driven device having an output shaft;
   e. means operatively connecting said output shaft of said wind driven device to said first compressor such that said wind driven device drives said compressor;
   f. heat radiating means connected to said compressor, and located within said enclosed structure to transfer heat from the evaporated liquid to the surrounding atmosphere causing said evaporated liquid to condense;
   g. first liquid receiving means connected to said heat radiating means and said first heat exchanger to receive and store the liquid from the heat radiating means; and wherein said liquid comprises a refrigerant; and
   h. a solar collector having an inlet connected to said first liquid receiving means and an outlet connected downstream of said compressor so as to transfer solar heat to the condensed refrigerant and cause the same to boil and evaporate; and
   i. means interposed between said solar collector and said liquid receiving means to control the flow of condensed refrigerant entering said solar collector.

2. The temperature control system of claim 1 further comprising:
   a. first pump means upstream of said solar collector inlet to pump condensed refrigerant into said solar collector;
   b. temperature sensing means located in the solar collector outlet to sense the temperature of the vaporized refrigerant; and
   c. means connecting said temperature sensing means and said first pump means to prevent operation of said first pump when the temperature of the vaporized refrigerant reaches a predetermined level.

3. The temperature control system of claim 1 wherein the temperature and pressure of the refrigerant evaporated by said solar collector are substantially equal to the temperature and pressure of the refrigerant vapor produced by said compressor.

4. The temperature control system of claim 1 wherein the means for operatively connecting said wind driven device to said compressor comprises:
   a. a driven shaft;
   b. first clutch means connecting said driven shaft to said output shaft of said wind driven device;
   c. a first sheave;
   d. second clutch means selectively connecting said first sheave to said driven shaft; and
   e. first belt means operatively connected to said first sheave and said compressor so as to drive said compressor when said first sheave rotates.

5. The temperature control system of claim 4 further comprising:
   a. pressure sensing means connected to the compressor discharge to sense the pressure of the compressed vaporized refrigerant; and
   b. means connecting said pressure sensing means and said second clutch means such that said second clutch is disengaged when said pressure reaches a predetermined level.

6. The temperature control system of claim 4 further comprising:
   a. an electric motor having an output shaft;
   b. a pulley affixed to said output shaft;
   c. a second sheave;
   d. third clutch means connecting said second sheave with said driven shaft; and
   e. second belt means connecting said second sheave with said pulley with that said electric motor serves to drive said driven shaft.

7. The temperature control system of claim 1 further comprising heat storage means connected to the system between the first compressor and the heat radiating means to selectively store heat.

8. The temperature control system of claim 7, wherein said heat storage means comprises:
   a. an insulating outer housing,
   b. a central coil to allow passage of the vaporized liquid therethrough,
   c. a cylindrical baffle member surrounding said central coil,
   d. a plurality of containers located within said housing, each container having a solid material therein which is capable of being melted in the temperature range at which the vaporized liquid operates;
   e. a fluid heat transfer medium passing in heat transfer relationship with said central heating coil and said plurality of containers so as to transfer heat from the vaporized fluid to said solid material in said containers and melt said solid material, and to cause said vaporized fluid to liquify; and
   f. means to control the level of liquified fluid in said central coil such that said level is at a minimum when heat is being stored and at a maximum when heat is being withdrawn.

9. The temperature control system of claim 8 wherein said means to control the liquid level in said central coil comprises:
   a. conduit means connecting an outlet of said central coil with said first liquid receiving means;
   b. valve means disposed in said conduit means to selectively control the flow of liquified fluid between said central coil and said first liquid receiving means;
   c. second pump means disposed in said conduit means to selectively pump liquified fluid between said first liquid receiving means and said central coil;

d. pressure sensing means to sense the pressure of the vaporized fluid entering said heat radiating means; and e. means connecting said pressure sensing means and said second pump means such that said second pump means pumps liquified fluid into said central coil when said pressure reaches a predetermined value.

10. The temperature control system of claim 8 wherein the solid material in said plurality of containers is paraffin.

11. The temperature control system of claim 8 wherein the solid material in said plurality of containers is asphalt.

12. The temperature control system of claim 1 wherein said source of heat comprises means to remove heat from the ambient atmosphere.

13. The temperature control system of claim 12 wherein said means to remove heat from the ambient atmosphere comprises:

a. second liquid receiving means for receiving and storing a liquid;

b. means connected to said second liquid receiving means to flash a portion of said liquid into vapor, thereby decreasing the temperature of the non-vaporous liquid;

c. second heat exchanger connected to said flash means so as to transfer heat from the ambient atmosphere to said low temperature fluid and cause same to vaporize;

d. a second compressor connected between second heat exchanger and said first heat exchanger to raise the temperature and pressure of the fluid vaporized by said second heat exchanger;

e. low temperature storage means connected between said second heat exchanger and said second compressor, and to said low temperature non-vaporous fluid; and f. means connecting said second compressor to said output shaft of the wind driven device, such that said wind driven device drives said compressor.

14. The temperature control means of claim 13 wherein said second heat exchanger is located within an enclosed structure and serves to remove heat from the atmosphere therein.

15. The temperature control means of claim 13 wherein a second pump means is provided between said flash means and said second heat exchange means to pump said low temperature fluid through said second heat exchange means.

16. The temperature control system of claim 13 wherein said liquid is a refrigerant.

17. The temperature control system of claim 15 further comprising:

a. means to sense the temperature of the ambient atmosphere;

b. means connecting said temperature sensing means to said second pump means such that said second pump only operates when said temperature of the ambient atmosphere reaches a predetermined value.

* * * * *